US008013743B2

(12) United States Patent
Roth et al.

(10) Patent No.: US 8,013,743 B2
(45) **Date of Patent: *Sep. 6, 2011**

(54) MARKER FOR A MAGNETIC THEFT PROTECTION SYSTEM AND METHOD FOR ITS PRODUCTION

(75) Inventors: Ottmar Roth, Gründau (DE); Hartwin Weber, Hanau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 1033 days.

This patent is subject to a terminal disclaimer.

(21) Appl. No.: 11/898,024

(22) Filed: Sep. 7, 2007

(65) Prior Publication Data

US 2008/0088451 A1 Apr. 17, 2008

(30) Foreign Application Priority Data

Oct. 2, 2006 (DE) ..... 10 2006 047 022

(51) Int. Cl.
*G08B 13/14* (2006.01)

(52) U.S. Cl. ..... 340/572.6; 340/572.1; 148/547; 148/310

(58) Field of Classification Search ..... 340/572.6, 340/572.1, 568.1; 428/611, 681; 148/120, 148/122, 102, 311, 312, 315, 304, 310, 547
See application file for complete search history.

(56) References Cited

U.S. PATENT DOCUMENTS 4,028,144 A 6/1977 Tomishima et al.
4,268,325 A 5/1981 O'Handley et al.
4,510,489 A 4/1985 Anderson, III et al.
4,536,229 A 8/1985 Jin et al.
5,176,806 A 1/1993 Hasegawa
5,395,460 A 3/1995 Martis
5,469,140 A 11/1995 Liu et al.
5,494,534 A 2/1996 Leu
5,568,125 A 10/1996 Liu
5,628,840 A 5/1997 Hasegawa
5,650,023 A 7/1997 Hasegawa et al.
5,671,524 A 9/1997 Damsky et al.
5,676,767 A 10/1997 Liu et al.
5,685,921 A 11/1997 Dulmaine (Continued)

FOREIGN PATENT DOCUMENTS

DE 2052710 C2 8/1986

(Continued)

OTHER PUBLICATIONS

"Magnetoechanical Properties of Amorphous Metals," Livingston, phys. Stat. sol.(a), vol. 70 (1982) pp. 591-596.

(Continued)

*Primary Examiner* — Anh V La
(74) *Attorney, Agent, or Firm* — Buchanan, Ingersoll & Rooney P.C.

(57) ABSTRACT

Disclosed are markers for a magnetic theft protection system, which markers contain at least one oblong alarm strip made of an amorphous ferromagnetic alloy and at least one activation strip made of a molybdenum-free semi-hard magnetic alloy consisting essentially of $Ni_aM_bFe_{Rest}$, wherein M is one or more of the elements from the group including Cr, W and V, and wherein a and b are weight percentages such that 15% by weight≦a≦25% by weight, and 2% by weight≦b≦8% by weight. The activation strip has a coercive force $H_c$ of 10 A/cm to 25 A/cm and a remanence $B_r$ of at least 0.9 T.

24 Claims, 4 Drawing Sheets

U.S. PATENT DOCUMENTS

| | | | | |
|---|---|---|---|---|
| 5,728,237 | A | 3/1998 | Herzer | |
| 5,729,200 | A | 3/1998 | Copeland et al. | |
| 5,786,762 | A | 7/1998 | Liu | |
| 5,841,348 | A | 11/1998 | Herzer | |
| 5,891,270 | A * | 4/1999 | Hasegawa | 148/304 |
| 6,011,475 | A | 1/2000 | Herzer | |
| 6,018,296 | A | 1/2000 | Herzer | |
| 6,057,766 | A | 5/2000 | O'Handley et al. | |
| 6,093,261 | A | 7/2000 | Hasegawa et al. | |
| 6,157,301 | A | 12/2000 | Radeloff et al. | |
| 6,166,636 | A | 12/2000 | Herget et al. | |
| 6,299,702 | B1 | 10/2001 | Herzer | |
| 6,359,563 | B1 | 3/2002 | Herzer | |
| 6,551,416 | B1 | 4/2003 | Herzer | |
| 6,645,314 | B1 | 11/2003 | Herzer et al. | |
| 6,663,981 | B1 | 12/2003 | Weber et al. | |
| 6,689,490 | B2 * | 2/2004 | Weber et al. | 428/682 |
| 6,803,118 | B2 | 10/2004 | Weber et al. | |
| 7,026,938 | B2 | 4/2006 | Herzer | |
| 7,088,247 | B2 | 8/2006 | Herzer et al. | |
| 7,276,128 | B2 | 10/2007 | Herzer et al. | |
| 7,432,815 | B2 | 10/2008 | Roth et al. | |
| 7,651,573 | B2 | 1/2010 | Herzer | |
| 2003/0129445 | A1 | 7/2003 | Weber et al. | |
| 2006/0170554 | A1 | 8/2006 | Herzer | |

FOREIGN PATENT DOCUMENTS

| | | | |
|---|---|---|---|
| DE | 19732872 | A1 | 2/1999 |
| DE | 19740908 | C1 | 8/1999 |
| EP | 0093281 | | 11/1983 |
| EP | 0121649 | B2 | 8/1995 |
| EP | 0944910 | B1 | 8/2002 |
| GB | 1331438 | | 9/1973 |
| WO | WO 8001857 | A1 | 9/1980 |
| WO | WO 9003652 | A1 | 4/1990 |
| WO | WO 96/32518 | | 10/1996 |
| WO | WO 97/32358 | | 9/1997 |
| WO | WO 9826434 | A1 | 6/1998 |

OTHER PUBLICATIONS

"Magnetomechanical Damping in Amorphous Ribbons with Uniaxial Anisotropy," Herzer, Materials Science and Engineering, A226-228 (1997) pp. 631-635.

"Effects of Longitudinal and Torsional Stress Annealing on the Magnetic Anisotropy in Amorphous Ribbon Materials," Nielsen, IEEE Trans. on Magnetics, vol. MAG-21, No. 5 (1985).

"Stress Induced Magnetic Anisotropy in a Non-Magnetostrictive Amorphous Alloy," Hilzinger, Proc. 4th Int. Conf. on Rapidly Quenched Metals (Sendai, 1981), pp. 791-794.

"Magnetic Anisotropy," Fujimori, from Amorphous Metallic Alloys, Luborsky, Ed. (1983), pp. 300-316.

Office Action dated Jun. 23, 2009 for U.S. Appl. No. 11/294,914.

Interview Summary dated May 14, 2009 for U.S. Appl. No. 11/294,914.

Advisory Action dated Apr. 17, 2009 for U.S. Appl. No. 11/294,914.

Final Office Action dated Jan. 30, 2009 for U.S. Appl. No. 11/294,914.

Office Action dated Jun. 27, 2008 for U.S. Appl. No. 11/294,914.

T.H. Tiefel et al., "Microduplex Fe-Ni-Mo semihard magnet alloys," J. Appl. Phys. 55 (6), Mar. 15, 1984, (pp. 2112-2114).

S. Jin et al., "High-Remanence Square-Loop Fe-Ni and Fe-Mn Magnetic Alloys," IEEE Transactions on Magnetics, vol. Mag. 16, No. 5, Sep. 1980, (pp. 1062-1064).

S. Jin et al., "New Ductile Fe-Mo-Ni Magnet Alloys," Bell Laboratories, Murray Hill, NJ, Abstract, Dec. 23, 1980, (3 pages).

Richard M. Bozorth, "Ferromagnetism," D. Van Nostrand Company, Inc., Princton, NJ, 1951, (pp. 148, 186, 188).

Ottmar Roth et al., "Marker for a Magnetic Theft Protection System and Method for Its Production", U.S. Appl. No. 11/905,486, filed Oct. 1, 2007.

* cited by examiner

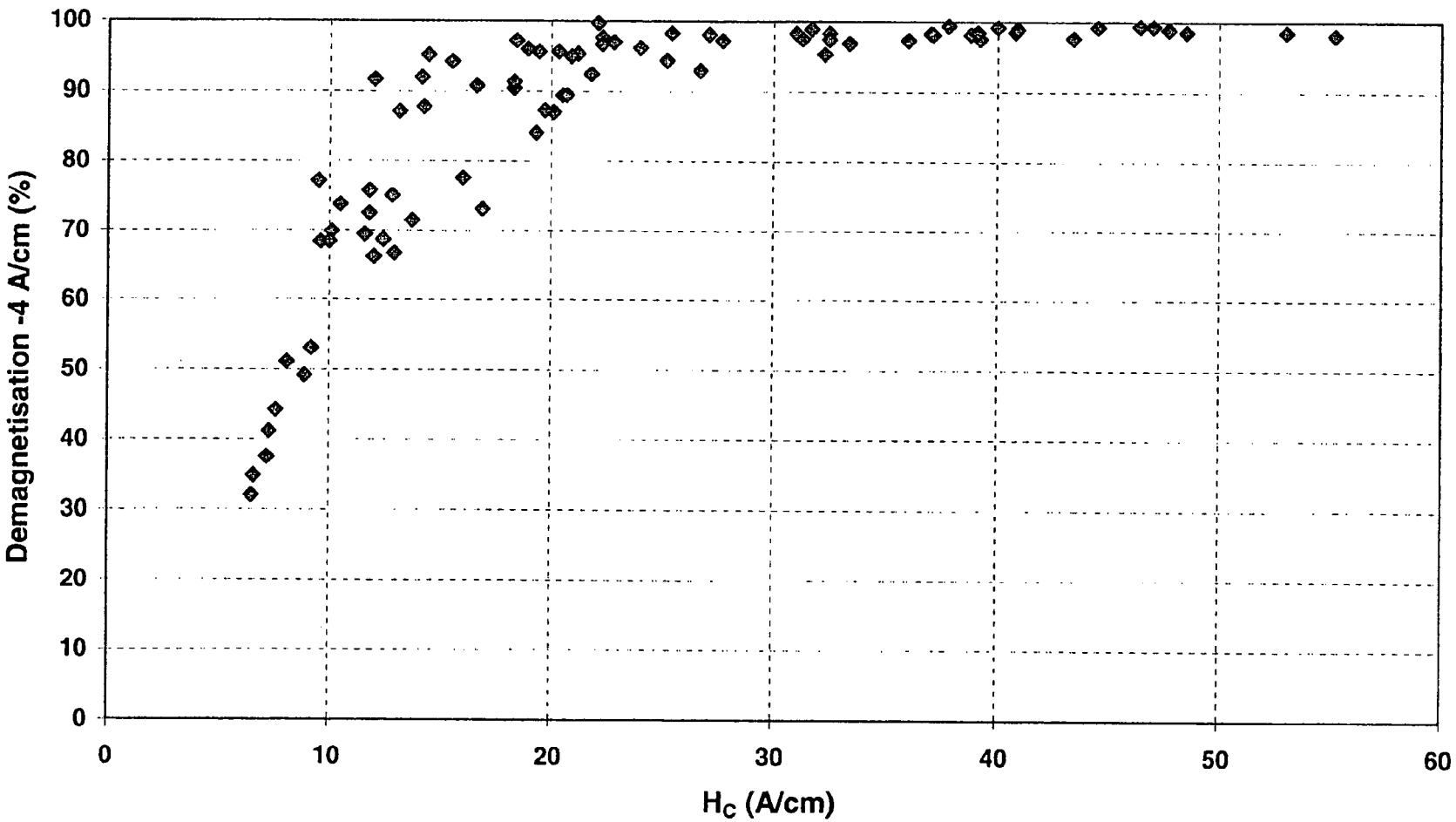
Figure 2: Demagnetisation at 4 A/cm as a function of $H_C$

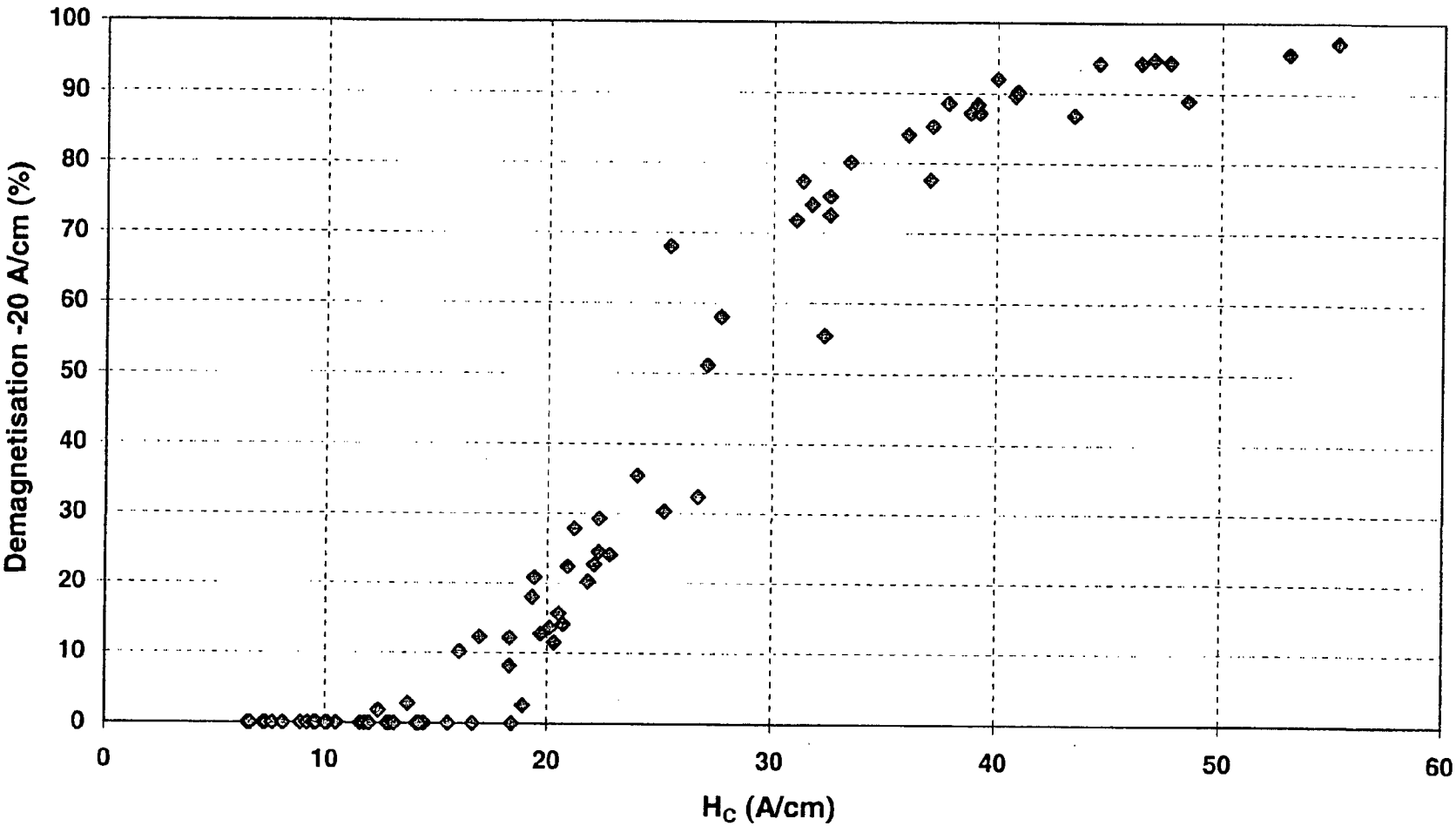
Figure 3: Demagnetisation at 20 A/cm as a function of $H_C$

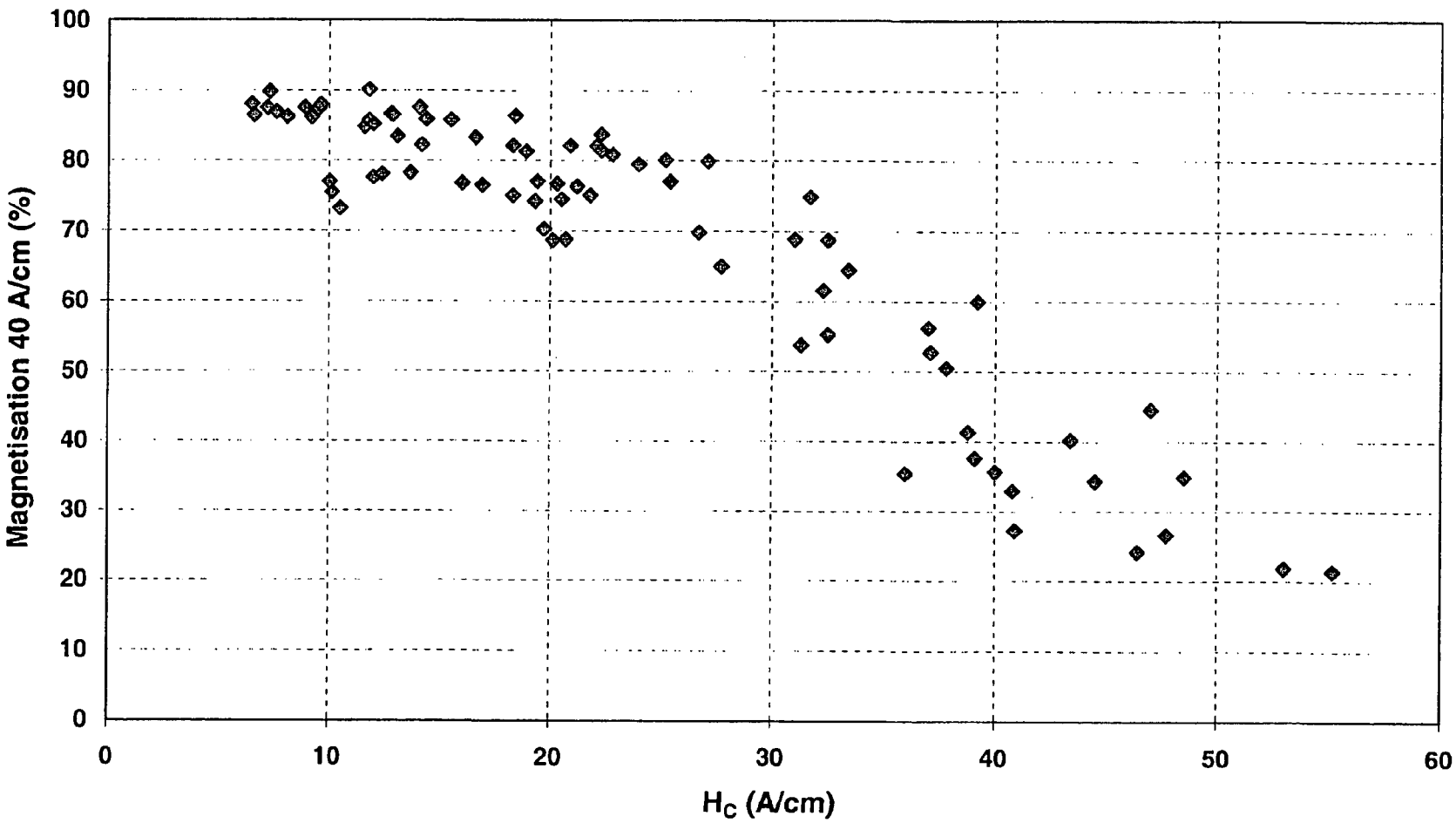
Figure 4: Magnetisation at 40 A/cm as a function of $H_C$

MARKER FOR A MAGNETIC THEFT PROTECTION SYSTEM AND METHOD FOR ITS PRODUCTION

BACKGROUND

1. Field

The invention relates to a marker for a magnetic theft protection system comprising at least one amorphous ferromagnetic alarm strip and at least one semi-hard magnetic activation strip. These markers can be used in magneto-elastic and in harmonic theft protection systems.

2. Description of Related Art

Certain magnetic theft protection systems and markers are for example, disclosed in EP 0 121 649 B1 and U.S. Pat. No. 5,729,200. In these theft protection systems, a detector system transmits a pulse which excites the alarm strip of the indication element, making the alarm strip vibrate with a characteristic resonant frequency. As a result, the detector system detects the alarm strip and triggers an alarm.

In magneto-elastic systems, the activation strip activates the alarm strip by means of magnetisation. In these systems, the alarm strip vibrates with a characteristic resonant frequency, while the activation strip is magnetised. The alarm strip is deactivated by a change of its resonant frequency. This is achieved by the demagnetisation of the semi-hard magnetic activation strip, making the alarm element vibrate at a different frequency which is not detected by the detector system.

In contrast to magneto-elastic systems, the magnetised activation strip of harmonic theft protection systems is used to deactivate the alarm strip.

The markers of theft protection systems are increasingly installed directly in or on the product to be secured, a method known as source tagging. In these systems, an operator is often responsible for the magnetisation or demagnetisation of the activation strip. This results in the additional requirement that it must be possible to magnetise or demagnetise the semi-hard magnetic alloy of the activation strip from a greater distance or using smaller fields.

It has been found that the coercive force has to be limited to a maximum of 25 A/cm for these applications. On the other hand, an adequate opposing field stability is also required, which determines the lower limit value of coercive force. Only coercive forces from 10 A/cm are suitable for this purpose.

Certain activation strips made of a semi-hard magnetic alloy with a coercive force meeting these requirements are, for example, disclosed in DE 197 32 872 and U.S. Pat. No. 5,685,921.

SUMMARY

The extension of the range of applications for markers is desirable. The known semi-hard magnetic alloys, in particular the molybdenum-containing alloys of U.S. Pat. No. 5,685,921, however, have the disadvantage that they have become more expensive in recent years owing to rising raw material costs.

The present invention is therefore based on the problem of providing alternative markers, in particular alternative semi-hard magnetic alloys for an activation strip of a marker, which meet the above requirements and can be produced cost-effectively.

This problem is solved by the subject matter of the independent claims. Advantageous further developments can be derived from the dependent claims.

The invention specifies a marker for a magnetic theft protection system comprising at least one oblong alarm strip made of an amorphous ferromagnetic alloy and at least one oblong activation strip. The activation strip is made of a molybdenum-free semi-hard magnetic alloy consisting essentially of $Ni_aM_bFe_{Rest}$, wherein M is one or more of the elements from the group including Cr, W and V, and wherein 15% by weight≦a≦25% by weight, 2% by weight≦b≦8% by weight. The activation strip further has a coercive force H, of 10 A/cm to 25 A/cm and a remanence $B_r$ of at least 0.9 T.

The coercive force and the remanence of the activation strip therefore meet the above requirements. The semi-hard magnetic alloy is further free of molybdenum, keeping raw material costs down. These alloys can also be produced in the form of a ductile strip, so that they can be used as activation strips in a marker.

In further embodiments, the activation strip has a remanence $B_r$ of at least 1.1 T. The activation strip may have a $H_c$ of 14 A/cm to 20 A/cm.

In one embodiment, 4% by weight≦b≦8% by weight, i.e. the content of the M element lies between 5% by weight and 8% by weight, M being one or more of the elements from the group including Cr, W and V.

The invention further provides for a tag with a marker according to any of these embodiments. The tag may comprise a housing which covers or encloses the marker. In a further embodiment, a layer of adhesive is placed on at least one side of the housing. The tag can therefore simply be attached by adhesive force to an object to be secured.

The invention further provides for an object, such as a consumer product to be sold, with a marker according to any of the above embodiments. The marker may be integrated into the object or attached thereto. The marker may be attached to the object in the form of a tag.

In a further embodiment, a packaging for a consumer product is provided with a marker according to any of the preceding embodiments. The packaging can be processed at the product's manufacturer, for example to produce a container. In a further step, the content can be placed into the packaging already fitted with a marker.

The invention further provides for a method for the production of an activation strip for a marker for a magnetic theft protection system. The activation strip comprises at least one oblong alarm strip made of an amorphous ferromagnetic alloy and at least one oblong activation strip. The method comprises the following steps:

A molybdenum-free semi-hard magnetic alloy consisting essentially of $Ni_aM_bFe_{Rest}$, wherein M is one or more of the elements from the group including Cr, W and V, and wherein 15% by weight≦a≦25% by weight, 2% by weight≦b≦8% by weight, preferably 4% by weight≦b≦8% by weight, is melted in a vacuum or an inert gas atmosphere and then cast to produce an ingot.

The ingot is hot-formed at a temperature above approximately 800° C. to produce a strip, whereupon the strip is process-annealed at a temperature of approximately 1100° C. and then rapidly cooled.

The cross-section of the strip is reduced by approximately 65% by cold forming, followed by annealing at a temperature of approximately 650° C. In a second step, the strip is cold-formed further, the reduction in cross-section being selected such that the remanence $B_r$ of the activation strip is >0.9 T, preferably >1.1 T. The strip is then tempered at a defined temperature and for a defined time. Tempering temperature and time are selected such that the activation strip has a coercive force of 10 A/cm to 25 A/cm, preferably 14 A/cm to 20 A/cm.

In one variant, the cross-section of the strip is reduced by at least 80%, preferably 95%, by cold forming after process annealing in order to obtain a remanence $B_r$ of >0.9 T, preferably >1.1 T.

In one variant, tempering is carried out at a temperature between 425° C. and 525° C. to obtain a coercive force of 10 A/cm to 25 A/cm, preferably 14 A/cm to 20 A/cm.

The strip is advantageously produced as a long strip to be cut into several pieces. In this way, the activation strips are cut to length.

A method for the production of a marker for a magnetic theft protection system comprising the following steps is also specified. An oblong alarm strip made of an amorphous ferromagnetic alloy and an oblong activation strip made of a molybdenum-free semi-hard magnetic alloy are provided. The molybdenum-free semi-hard magnetic alloy consists essentially of $Ni_aM_bFe_{Rest}$, wherein M is one or more of the elements from the group including Cr, W and V, and wherein 15% by weight≦a≦25% by weight, 2% by weight≦b≦8% by weight. The activation strip has a coercive force H, of 10 A/cm to 25 A/cm and a remanence $B_r$ of at least 0.9 T.

To produce a marker, at least one alarm strip is placed on at least one activation strip. The large-area sides of the alarm strip and the activation strip are arranged on top of one another to produce a stack. In this arrangement, the activation strip can reliably bias the alarm strip, so that the alarm strip has the desired characteristic resonant frequency.

The alarm strip and the activation strip of the marker may be located in a housing and provided in the form of a tag. This tag may be removably attached to an object to be secured.

In a further variant, the alarm strip and the activation strip of the marker are placed in a packaging for a consumer product to provide a packaging with an marker.

BRIEF DESCRIPTION OF THE DRAWINGS

FIG. 2 is a graph that illustrates the demagnetisation behaviour of certain embodiments of activation strips comprising certain molybdenum-free semi-hard alloys described herein at 4 A/cm as a function of coercive force.

FIG. 3 illustrates the demagnetisation behaviour of certain embodiments of activation strips comprising certain molybdenum-free semi-hard alloys described herein at 20 A/cm as a function of coercive force.

FIG. 4 illustrates the magnetisation behaviour of certain embodiments of activation strips comprising certain molybdenum-free semi-hard alloys described herein at 40 A/cm as a function of coercive force.

DETAILED DESCRIPTION OF SPECIFIC EMBODIMENTS

Figure 1:
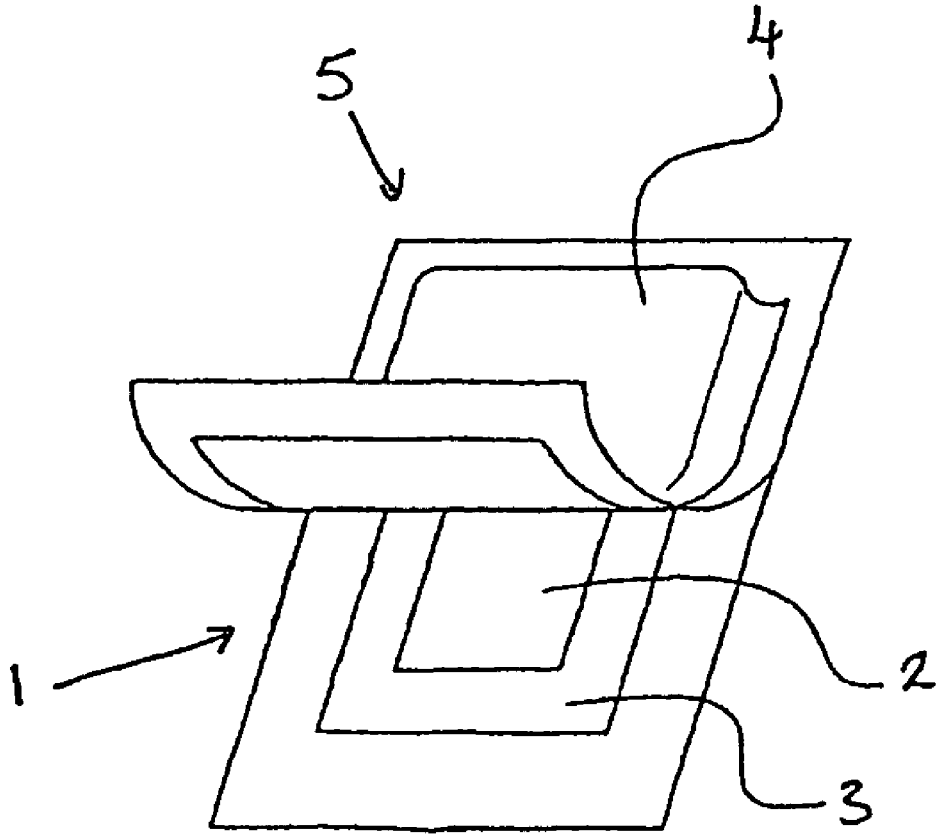
FIG. 1 is a schematic diagram showing a marker with an alarm strip and an activation strip.

The invention will be more clearly understood by reference to the specific embodiments and figures, which are not intended to limit the scope of the invention, or of the appended claims.

The invention is explained in greater detail with reference to the figures and embodiments.

FIG. 1 shows a marker 1 comprising an alarm strip 2 and an activation strip 3. A large-area side of the alarm strip 2 is placed on a large-area side of the activation strip 3, thus forming a stack. The alarm strip 2 is made of an amorphous ferromagnetic alloy, while the activation strip 3 is made of a molybdenum-free semi-hard magnetic alloy according to any of the embodiments of the invention.

The marker 1 is located in a housing 4 made of plastic, which has the form of a tag 5. In further embodiments not shown in the drawing, the housing 4 is an object or article, such as a consumer product or a packaging for a consumer product.

In this embodiment, the marker is destined for use in a magneto-elastic theft protection system. The activation strip 3 is therefore magnetised to activate the alarm strip 2. When excited, the alarm strip 2 vibrates in a detector system not shown in the drawing with a characteristic resonant frequency recognised by the detector system as a marker.

To produce the activation strip, alloys with a composition of $Ni_{20}Cr_{2.5}Fe_{Rest}$, $Ni_{20}Cr_5Fe_{Rest}$, $Ni_{20}V_5Fe_{Rest}$ and $Ni_{20}W_8Fe_{Rest}$ are produced in the form of ductile foils.

The alloy with the desired composition is first melted in a vacuum or an inert gas atmosphere at a temperature of 1600° C. and then cast to produce an ingot. The ingot is hot-formed at temperatures above 800° C. to produce a first strip. This first strip is annealed in a first process annealing step at a temperature of approximately 1100° C. and then rapidly cooled. The cooled, annealed first strip is cold-formed to reduce its cross-section by approximately 65% to form a second strip, and then annealed in a second process annealing step at a temperature of 650° C. to form an annealed second strip. In a second cold forming step, the cross-section of the annealed second strip is reduced by at least 80%, more particularly by at least 90%, even more particularly by at least 95%. The strip is then tempered for 1 to 3 hours at a temperature between 425° C. and 525° C. to form activation strips, which can optionally be cut to length.

Batches of alloys with a composition of $Ni_{20}Cr_{2.5}Fe_{Rest}$, $Ni_{20}Cr_5Fe_{Rest}$, $Ni_{20}V_5Fe_{Rest}$ and $Ni_{20}W_8Fe_{Rest}$ were produced and examples with these compositions were processed with various degrees of reduction in cross-section and in various tempering conditions.

The magnetic properties coercive force $H_c$, magnetisation at 40 Oe, demagnetisation at 4 Oe and demagnetisation at 20 Oe were measured. These values are listed in Table 1 and illustrated in FIGS. 2 to 4.

For use as a marker, the activation strip has to have a defined magnetisation and demagnetisation behaviour. The remanence $B_r$ after an opposing field of 4 Oe should retain 90%, preferably 95%, of its original value to ensure an adequate opposing field stability. In this way, the resonant frequency of the alarm strip is not influenced by low magnetic fields in a way which would prevent the detection of the marker.

FIG. 2 illustrates the demagnetisation behaviour at 4 A/cm as a function of coercive force. As FIG. 2 shows, this requirement is met by the alloys according to the invention.

Following a demagnetisation cycle at 25 Oe, the remanence $B_r$ should be less than 20% of its original value to enable the activation strips to be demagnetised by smaller magnetic fields. An upper limit of 22 A/cm for coercive field strength is desirable for rapid magnetisation.

FIG. 3 illustrates the demagnetisation behaviour at 20 A/cm as a function of coercive force and shows that the alloys according to the invention can be demagnetised by relatively small magnetic fields. Relatively small magnetic fields are therefore capable of deactivation the markers of magneto-elastic systems and of activation those of harmonic systems.

FIG. 4 illustrates the magnetisation of the alloy according to the invention. For use as an activation strip, the ratio between the remanence at a given low magnetisation field strength and the remanence $B_r$ at a magnetic field in the kOe range should be nearly 1. FIG. 4 shows this for the alloys according to the invention.

Table 1 indicates that the required magnetisation and demagnetisation behaviour is controlled by coercive field strength.

At coercive field strengths below approximately 10 A/cm, the remanence $B_r$ following demagnetisation at 4 Oe is less than 90%, so that the opposing field stability requirements are not met. In contrast, at coercive field strengths above approximately 25 A/cm, the remanence after demagnetisation at 20 Oe is above 25%, so that the demagnetisation requirements are not met.

The coercive force H, should therefore lie between 10 A/cm and 25 A/cm, so that the alloys can meet the requirements for use as activation strips of a marker. Table 1 further shows that the alloys should preferably have a coercive force between 15 A/cm and 22 A/cm.

It was found that the coercive force was controlled by the reduction in cross-section achieved in the cold forming and tempering process. By a suitable choice of these conditions, an alloy with a composition of $Ni_{20}Cr_5Fe_{Rest}$, $Ni_{20}V_5Fe_{Rest}$ and $Ni_{20}W_8Fe_{Rest}$ can be provided which has a remanence $B_r$>1.0 T and a coercive force H, between 10 A/cm and 25 A/cm, thereby meeting the requirements of an activation strip of a marker.

EXAMPLE 1

An alloy with a composition of $Ni_{20}V_5Fe_{Rest}$ (batch 93/4574) was first melted at a temperature of 1600° C. in a vacuum or an inert gas atmosphere and then cast to produce an ingot. The ingot was hot-formed at temperatures above 800° C. to produce a strip. This strip was annealed in a first process annealing step at a temperature of approximately 1100° C. and then rapidly cooled. The strip was cold-formed to reduce its cross-section by approximately 70% and then annealed in a second process annealing step for 1 hour at a temperature of 650° C. In a second cold forming step, the cross-section was reduced by up to 95%. The strip was then tempered for 3 hours at a temperature of 520° C. A coercive force of 18 A/cm and a remanence of 1.1 T were measured.

EXAMPLE 2

An alloy with a composition of $Ni_{20}W_8Fe_{Rest}$(batch 93/4575) was first melted at a temperature of 1600° C. in a vacuum or an inert gas atmosphere and then cast to produce an ingot. The ingot was hot-formed at temperatures above 800° C. to produce a strip. This strip was annealed in a first process annealing step at a temperature of approximately 1100° C. and then rapidly cooled. The strip was cold-formed to reduce its cross-section by approximately 70% and then annealed in a second process annealing step for 1 hour at a temperature of 650° C. In a second cold forming step, the cross-section was reduced by up to 90%. The strip was then tempered for 3 hours at a temperature of 500° C. A coercive force of 22 A/cm and a remanence of 1.11 T were measured.

The invention having been described herein by reference to one or more specific embodiments or examples, it will be apparent to those of skill in the art that such embodiments and examples are not limitative of the appended claims.

LIST OF REFERENCE NUMBERS

1 Marker
2 Alarm strip
3 Activation strip
4 Housing
5 Tag

The invention claimed is:

1. A marker for a magnetic theft protection system, comprising:

(a) at least one oblong alarm strip comprising an amorphous ferromagnetic alloy; and (b) at least one oblong activation strip consists essentially of a molybdenum-free semi-hard magnetic alloy of formula $Ni_aM_bFe_{Rest}$, wherein M is one or more of the elements selected from the group consisting of Cr, W and V, and wherein a and b are weight percentages, such that 15% by weight ≦a≦25% by weight, and 2% by weight ≦b≦8% by weight, and wherein said activation strip has a coercive force $H_c$ of 10 A/cm to 25 A/cm and a remanence $B_r$ of at least 0.9 T.

2. The marker according to claim 1,
wherein said remanence $B_r$ is at least 1.1 T.

3. The marker according to claim 1,
wherein said coercive force $H_c$ is between 14 A/cm and 20 A/cm.

4. The marker according to claim 1,
wherein b is a weight percentage such that 4% by weight ≦b≦8% by weight.

5. A tag comprising a marker according to claim 1.

6. The tag according to claim 5,
further comprising a housing enclosing said marker.

7. The tag according to claim 6,
further comprising a layer of adhesive applied to at least one side of said housing.

8. An article comprising a marker according to claim 1.

9. An article comprising a tag according to claim 5.

10. The article of claim 8, wherein said article comprises a consumer product or packaging for a consumer product.

11. A method for the production of an activation strip for a marker for a magnetic theft protection system that comprises at least one oblong alarm strip comprising an amorphous ferromagnetic alloy, and at least one oblong activation strip, said method comprising:

(a) melting a molybdenum-free semi-hard magnetic alloy consisting essentially of $Ni_aM_bFe_{Rest}$, wherein M is one or more of the elements from the group including Cr, W and V, and wherein a and b are weight percentages, such that 15% by weight ≦a≦25% by weight, and 2% by weight ≦b≦8% by weight, in a vacuum or an inert gas atmosphere;

(b) casting said melted alloy to produce an ingot;

(c) hot forming of said ingot at temperatures above approximately 800° C. to produce a first strip;

(d) process annealing of said first strip at a temperature of approximately 1100° C. to form an annealed first strip;

(e) rapidly cooling said annealed first strip to form a cooled annealed first strip;

(f) cold forming said cooled annealed first strip to a reduction in cross-section of approximately 65% to form a second strip;

(g) process annealing said second strip at a temperature of approximately 650° C. to form an annealed second strip;

(h) cold forming said annealed second strip to reduce cross-section to form a third strip, wherein the reduction in cross-section is selected such that said third strip has a remanence $B_r$>0.9 T; and (i) tempering said third strip at a defined temperature and for a defined time, said temperature and time being selected to produce an activation strip having a coercive force $H_c$ of 10 A/cm to 25 A/cm.

12. The method according to claim 11,
said cold forming of said annealed second strip corresponds to a reduction in cross-section of at least 80%.

13. The method according to claim 11, wherein said tempering is carried out at a temperature between 425° C. and 525° C.

14. The method according to claim 11, further comprising cutting said activation strips to length.

15. The method according to claim 11, wherein b is a weight percentage such that 4% by weight ≦b≦8% by weight.

16. The method according to claim 11, wherein said remanence $B_r$>1.1 T.

17. The method according to claim 16, wherein said remanence $B_r$>1.3 T.

18. The method according to claim 11, wherein said coercive force $H_c$ is 14 A/cm to 20 A/cm.

19. The method according to claim 11, wherein said reduction in cross-section is at least 90%.

20. The method according to claim 11, wherein said reduction in cross-section is at least 95%.

21. A method for the production of a marker for a magnetic theft protection system, comprising:

(a) providing at least one oblong alarm strip comprising an amorphous ferromagnetic alloy;

(b) providing at least one oblong activation strip consisting essentially of a molybdenum-free semi-hard magnetic alloy having formula $Ni_aM_bFe_{Rest}$, wherein M is one or more of the elements from the group including Cr, W and V, and wherein a and b are weight percentages, such that 15% by weight ≦a≦25% by weight, and 2% by weight ≦b≦8% by weight, and wherein said activation strip has a coercive force $H_c$ of 10 A/cm to 25 A/cm and a remanence $B_r$ of at least 0.9 T; and (c) placing said at least one oblong alarm strip on said at least one oblong activation strip to produce said marker.

22. The method according to claim 21, further comprising locating said oblong alarm strip and said oblong activation strip of said marker in a housing.

23. The method according to claim 21, further comprising locating said oblong alarm strip and said oblong activation strip of said marker in a packaging of a consumer product.

24. An oblong activation strip suitable for a marker for a magnetic theft protection system, comprising an alloy consisting essentially of a molybdenum-free semi-hard magnetic alloy of formula $Ni_aM_bFe_{Rest}$, wherein M is one or more of the elements selected from the group consisting of Cr, W and V, and wherein a and b are weight percentages, such that 15% by weight ≦a≦25% by weight, and 2% by weight ≦b≦8% by weight, and wherein said activation strip has a coercive force $H_c$ of 10 A/cm to 25 A/cm and a remanence $B_r$ of at least 0.9 T.

* * * * *